United States Patent [19]

Kuramoto et al.

[11] Patent Number: 4,770,019

[45] Date of Patent: Sep. 13, 1988

[54] FORMING ROLL, FORMING PROCESS AND ITS APPARATUS IN THE PIPE MILL

[75] Inventors: Ryosuke Kuramoto, Tondabayashi; Atumu Okamoto, Toyonaka; Takashi Tomino, Yamatokoriyama, all of Japan

[73] Assignee: Nakata Manufacture Company Limited, Osaka, Japan

[21] Appl. No.: 913,670

[22] PCT Filed: Jun. 30, 1986

[86] PCT No.: PCT/JP86/00337

§ 371 Date: Sep. 2, 1986

§ 102(e) Date: Sep. 2, 1986

[87] PCT Pub. No.: WO87/04096

PCT Pub. Date: Jul. 16, 1987

[30] Foreign Application Priority Data

| | | | |
|---|---|---|---|
| Dec. 28, 1985 | [JP] | Japan | 60-299444 |
| Dec. 30, 1985 | [JP] | Japan | 60-297290 |
| Jan. 14, 1986 | [JP] | Japan | 61-5560 |

[51] Int. Cl.[4] ..... B21D 5/12; B21D 39/00

[52] U.S. Cl. ..... 72/181; 72/178; 72/176; 72/52; 29/129.5; 29/110

[58] Field of Search ..... 72/181, 182, 179, 178, 72/176, 51, 52, 83; 29/129.5, 125, 110

[56] References Cited

U.S. PATENT DOCUMENTS

| | | | |
|---|---|---|---|
| 2,012,795 | 8/1935 | Park | 72/181 |
| 3,914,971 | 10/1975 | Colbath | 72/181 |
| 4,070,887 | 1/1978 | Hankin | 72/181 |
| 4,090,387 | 5/1978 | Dubreuil | 72/217 |

FOREIGN PATENT DOCUMENTS

| | | | |
|---|---|---|---|
| 1115880 | 4/1956 | France | 72/83 |
| 27654 | 7/1984 | Japan . | |
| 150620 | 8/1984 | Japan . | |
| 484914 | 9/1975 | U.S.S.R. | 72/52 |

*Primary Examiner*—Daniel C. Crane

*Attorney, Agent, or Firm*—Laurence R. Brown; Alfred J. Mangels

[57] ABSTRACT

To promote the forming performance of band material into pipes and to decrease the number of forming stages and changes of the forming rolls in the pipe mill, considering that it is superior when forming the band material into pipes of required diameters if the sectional shape of the band material is provided with a curved surface which changes its curvature continuously into the required diameter, we provide a curved roll surface of numerous curvatures changing continuously. In a continuous roll forming in accordance with the present invention, a forming roll having an approximate involute curve based upon a polygon comprising a plurality of sides is used. By using the conventional rolls in various combinations therewith in each stage of forming as a horizontal roll, side roll and upper intermediate roll or a cage roll, the number of stages of the forming roll can be reduced. Moreover, the production of steel pipes having various diameters and thicknesses in a broader range from small diameter to large diameter pipes can be formed by a single set of forming rolls. Also the edge bending of the band material is corrected and the influence due to its spring back is reduced to increase the formability in the initial and intermediate forming stages in the pipe mill.

17 Claims, 15 Drawing Sheets

Fig. 15a
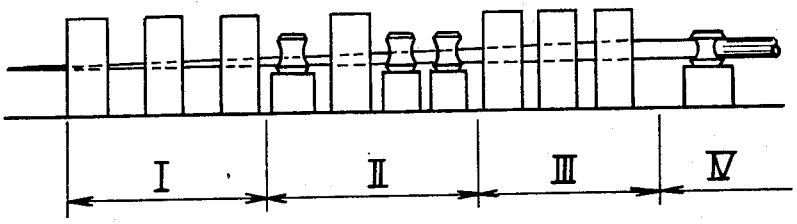
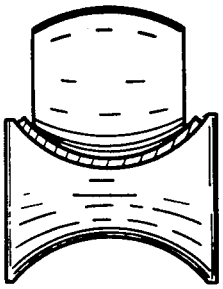
Fig. 15b
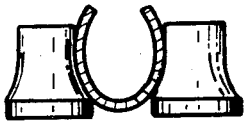
Fig. 15c
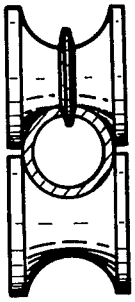
Fig. 15d

FORMING ROLL, FORMING PROCESS AND ITS APPARATUS IN THE PIPE MILL

FIELD OF THE TECHNOLOGIES

The present invention is related to a novel forming roll, a forming process of the band material utilizing said forming roll and its forming apparatus to be used in each forming region or the forming stages such as the edge forming of the band material, or the forming region of its center portion which is to be formed substantially circularly, in producing the steel pipes consisting of various materials such as the seam welded steel pipe or the steel pipe formed by a continuous roll forming. More particularly, the present invention relates to a forming roll, forming process and its apparatus in the pipe mill having a broader commonly used range and an application range to each forming region, in which the band material suitable for producing the pipes having various diameters and thicknesses in a broader range from the small diameters to large diameters, may be formed by a single set of rolls without changing them further in spite of a considerably broader commonly used range of the roll, for example, when used as the edge bending roll of the band material, the edge may be bent sufficiently and accurately, besides as the forming roll for the center portion of the band material, the line contact with the bending edge portion is possible, having advantages in reducing the roll surface pressure, in forming the required roundness, in compensating the insufficient and poor bending in the preceding bending stage, and in avoiding the rolling of the material being rolled.

BACKGROUND OF THE ART

The lineal seam welded steel pipe is produced mainly as the so-called seam welded steel pipe, which is formed by a continuous roll forming of the band steel by using the forming roll suitable for forming the required diameter and thickness and arranged according to the requirement as to its diameter, which is most suitable for the mass production concentrated in a fewer kinds of items.

In the production of steel pipes by the continuous roll forming, the whole process is roughly divided, as is shown in FIG. 15, into the edge forming section I of the band steel, the center forming section II and the reducing section III, in which the initial forming from the edge bending to the half-circularizing are effected by the horizontal roll clusters (FIG. 15-*b*), then formed substantially to the circle by non-driven side roll clusters (FIG. 15-*c*), and the angle adjustment of the edge, reducing, finishing and centering are performed by so-called fin pass rolls (FIG. 15-*d*), then led to the welding process IV by squeeze rolls.

In the above process, the horizontal and side rolls are usually arranged in many combinations, and furthermore for the purpose of preventing the edge stretch occurring when forming the relatively thin pipe, a cage forming process arranged with a number of small rolls having a flat surface called cage rolls is used together.

In such conventional continuous roll forming process, the initial forming stage is important for mainly forming a half-circle in the initial stage, is spite of the fact that the edge bending of the band steel is most difficult and generally influencing the proper roundness of the pipe and the quality of welding process is insufficient and numerous cases of springing back are produced after the forming due to the poor forming, mainly from the requirement of production cost, the method of forming of center portion in the following forming region is performed by adding the forming stages without completely finishing the edge bending, and the whole process is thus chosen to compensate such insufficient forming in the initial and intermediate stages in a breath in the reducing region.

Accordingly, since the additional forming in the reducing region due to the insufficient forming in the initial and intermediate stages is not desirable from the point of proper distribution of forming processes in the whole process when the accuracy and productivity of the product and economical aspects of the forming apparatus is considered, besides that insufficient edge bending and the so-called angular distortion in the intermediate forming stage will influence the proper roundness of the pipe and the welding quality, the forming process or the forming apparatus which performs the edge bending in the edge bending stage sufficiently, or compensates the insufficient bending in the following stage to prevent the angular distortion was an obvious need.

Furthermore, as previously described, the production of welded steel pipe by the continuous roll forming method requires the forming rolls suitable for forming to the required diameter and thickness, properly arranged in accordance with its required width of the material to be formed, thus a considerable number of forming rolls should have to be prepared for every required diameters. This is not desirable from the production efficiency, and consequently this process has been used for the mass production of smaller items. Recently, therefor, the efficient production of large items with a single machine is needed, that is, the continuous roll forming process or the forming apparatus suitable for the small quantity production of large items, not to speak of mass production of small items, is demanded.

Moreover, in the double radius forming, because the edge bending curvature will change as the diameter varies, when a common roll is used with the bending portion not possible to be pressed and the circular portion being pressed as contacting with straight rolls or rolls having relatively larger radius of curvature at the points, thus the formability of roundness is deteriorated and the angular distortion tends to occur.

When a plurality of abovementioned cage rolls are utilized to use the roll commonly, similarly a flat roll should be used, resulting in the material being formed tending to roll.

Meanwhile, the forming roll having three kinds of curved surfaces is proposed in Japanese Patent No. 46926/82 as the break down forming roll for several kinds of pipes having different diameters.

More specifically, the abovementioned break down forming roll includes the roll surface, in which the curved surface having the center angle of 15°–45° and the bending radius required for bending the edge of the band steel of the pipe having a maximum planned diameter, the curved surface having the center angle of 40°–55° and the bending radius required for bending the edge of the band steel of the pipe having a minimum diameter, and the curved surface having the center angle of 5°–45° and the bending radius required for the break down of the inner curved surface following the edge portion of the band steel of said minimum diameter pipe, are arranged in sequence from the outside to inside of the roll surface, the break down rolls being respectively arranged in the multi-stage stand so as to complete the break down of the forming section 1 of the edge portion of the band steel mentioned above.

In the break down roll, since it is intended to use the roll commonly within the several pipe diameter ranges, and to decide three kinds of curved surfaces of the roll on the basis of maximum and minimum pipe diameter in the commonly used range, in the edge bending of the band steel performed at the required multi-stage conventionally used, similarly as in the past, the multi-forming is essential and the number of forming stands could not be reduced, besides the distribution of forming is exactly as same as the convention process mentioned above, so that the insufficient formability occurred in the initial and intermediate stages is planned to be corrected at a breath in the reducing region.

DISCLOSURE OF THE INVENTION

In view of the above conditions, an object of the present invention is to provide a forming roll, forming process and its apparatus having a broader application range in the commonly used range and in each forming region in the pipe mill, in which when producing the steel pipe of various materials such as forming the seam welded steel pipe by the continuous roll forming, the bending of edge and forming of the center portion of the band steel into a substantially circular shape, may be performed on various diameters and thicknesses in the broader range from a small diameter to large diameter pipes by a set of rolls without changing it, besides the edge may be bent accurately and sufficiently, and the forming stages in each forming region may be reduced, or when forming the center portion of the band material, the insufficient bending may be corrected and the angular distortion can be prevented to produce the properly shaped pipes.

As described above, as the result of many studies performed for the purpose of improving the formability of band steel and reducing the forming stages and/or changing of the forming rolls, and believing that when forming the band material into a required diameter, it is most natural and giving a high formability to render a curved surface having continuous changing curvatures to the sectional shape of the band material as being converged into the required outside diameter, the present invention has been accomplished by forming the band material with the roll having the curved surface comprising a number of or numerous groups of curvatures which changed continuously and in a fixed relationship, and/or turning the head of one or both of a pair of forming rolls having said roll surface in a lateral direction of the band material, to contact the required portion of the band material only to the groups of curvatures necessary for the required diameter and forming stage and changing continuously.

That is, the present invention comprises the forming roll for the pipe mill, a continuous forming process utilizing this forming roll, and its apparatus, characterized in that, in forming each portion of the band material in the forming region in the production of pipes by a continuous roll forming, in order to form with a part or whole roll surface as changing the contacting direction of the forming roll responsive to the width of the band steel being formed and the required forming stage, a part or the whole sectional curve of the roll surface comprises the sectional shape of involute curve obtained from a side or sides of polygon having a plurality of sides previously set, so as to agree with the curve of the required portions of the band steel in each roll flower of the steel pipes having various diameters in said forming region.

The forming roll in accordance with the present invention will be explained in detail as follows;

In general, in the continuous forming, it is essential to consider the amount of forming bearable by a plurality of stands, thus the movement of the edge of the band steel is devised to maintain the equal intervals generally at each forming stand, considering the roll flower diagram of the edge bending and/or circular bending besides a usual distribution of curvature in a center portion.

For example, in the break down rolling (the forming region of the edge portion of the band material) previously described, since the number (n) of forming stages are set to form by the forming rolls of n in sequence as reducing the bending radius, the bending rolls in each stage have the roll surface consisting respectively of a single or a few circular arcs of required radius (R).

Accordingly, when bending the vicinity of the edge portion, it is essential to use the forming roll with the sectional shape having a curvature adjusted to its pipe diameter, and said roll can not be used commonly for forming the different diameter.

In other words, in the conventional forming process, the forming is performed in multi-stages by the roll surfaces having a single or a few circular arcs as mentioned above, but in practice, since the sectional shape of the band material is not such a single circular arc, but its curvature is believed to be changed continuously, the forming of band material is performed only by the curved surface having only one or few resembled curvatures among numerous conceivable curvatures, thus as previously described, the formability to the required shape is low and a large correction is needed in the following process.

For improving the formability, it may be considered to increase the forming stages, which is totally against the objects of forming efficiency, economical respects and common utilization of the forming roll.

Accordingly, we have studied to form the roll surface of the forming roll by the curved surface having a plurality of curvatures, in order to approach the practical or ideal forming previously described. However, a high formability and common use of the forming roll can not be achieved merely by combining a number of curvature at random. As the result of various studies, we have found that the roll surface comprising the curved surface, forming with a plurality of or numerous curvature groups changing the curvatures continuously with a constant relevancy is most suitable.

That is, the roll surface comprising the curved surface formed with a plurality of or numerous curvature groups changing the curvatures continuously, corresponds to the roll surface having the sectional shape of involute curve based upon the polygon comprising a plurality of sides previously set as referred to in the present invention.

The involute curve (hereinafter referred to as the approximate involute curve) based upon such polygon formed with a plurality of sides previously set, comprises the involute curve based upon the polygon in which various curved surfaces changing the curvature continuously are assumed, so as a part or whole of the sectional curve of the roll surface will agree with the curve of the required portion of the band steel of each roll flower of the steel pipes having outside diameters in said forming region, for example, it may be a formal involute curve based upon certain base circle besides practically obtained from the involute curve based upon said circle or the ellipse.

This is because, as previously described, if the sectional shape of the band material is believed to be changing its curvature continuously in the forming, when assuming the curved surface agreeing entirely with said curvature, the polygon upon which the approximate involute curve referred to in the present invention is based, is formed with a considerable number of sides and is convergeable within the constant circle, thus the involute curve based thereupon may be involved as well.

In the forming roll in accordance with the present invention, for example, since all curved surfaces among the curved surfaces changing the curvature continuously and necessary for the edge bending may be involved, the edge bending can be completed in a high formability in the first forming stage, or the stages may be added if necessary, or the curved surface assumed by considering the working efficiency of forming or the production capacity of rolls, may be provided on the roll surface of each forming roll in succession to the approximate involute curve.

Meanwhile, in the forming roll in accordance with the present invention, as the curved surface changing the curvature continuously and necessary for the forming, may be set in one roll surface by assuming a plurality of different diameters, the forming roll may be used commonly and only the curved surface necessary for forming the required diameter may be utilized.

By utilizing the forming roll in accordance with the present invention, the forming process of the edge portion of the band material in the pipe mill may be performed as follows:

For example, in forming the edge portion of the band material in the forming region, opposite ends of the band material are formed respectively by a pair of upper and lower forming rolls having the sectional shape of said involute curve, when forming in one or multi-stages the distance between the pair of forming rolls at the opposite ends of the band material is changed responsive to the band width, and when necessary the roll for protruding the center portion of the band material upwardly is used, at least the pressing direction of the upper forming roll of each pair of forming rolls is changed, and responsive to the width and required edge bending stage of the band material being formed, a part or whole surface of the approximate involute curve of the sectional shape of the forming roll previously set is used.

That is, the forming process of the edge portion of the band material utilizing the forming roll in accordance with the present invention, is capable of forming the edge portion suitable for the production of the steel pipes, having various diameters and thicknesses in a broader range from small diameter to large diameter pipes by a single set of forming rolls without changing it, and of reducing the influence due to springing back, thus considerably improving the formability at the initial forming stage and reducing the improper edge portion in the pipe mill.

Furthermore, by utilizing the forming roll in accordance with the present invention, in forming the center portion of the band material in the forming region after said edge bending, the forming process in the pipe mill may be performed by pressing the edge bending portion of the band material by the side forming roll having the sectional shape of said involute curve, by changing the distance between a pair of side rolls responsive to the band width, and the contacting direction of the side rolls responsive to the width of the band material being formed and the required forming stage, when it is formed generally in a circular shape by arranging the side rolls in one stage or multi-stages, and by forming with a part or whole surface of the approximate involute curve of the sectional shape of the side rolls previously set; and the forming process commonly using the intermediate roll contacting the center portion of the band material from the upper side, and/or the horizontal roll contacting from the underside responsive to the forming stage may be performed.

That is, the forming process of the center portion of the band material utilizing the forming roll in accordance with the present invention, is capable of forming the center portion of the band material suitable for the production of the steel pipes, having various diameters and thicknesses in a broader range from small diameter to large diameter pipes by a single set of forming rolls without changing it, by using only the side rolls having said shape, or commonly using the upper intermediate roll and/or lower horizontal roll capable of contacting with the center portion of the band material, besides the insufficient edge bending in the preceding stage may be corrected and the influence of spring back may be reduced, thus the improper edge and the amount of forming in the following reducing region may be reduced to provide the continuous roll forming having a good forming distribution and a high formability.

Moreover, by utilizing the forming rolls in accordance with the present invention in all forming stages in the pipe mill, the number of forming stages and/or forming rolls can be reduced considerably and the change of rolls is not necessary, in addition, in each stage in the aforementioned edge forming and/or the forming region of the center portion, irrespective of driven or not driven, it can be used as the roll serving as the well-known horizontal roll, side roll, upper and lower intermediate rolls or cage roll, or it may be used commonly with the well-known conventional forming rolls alternately in every forming stages, by suitable selecting whether it is movable or rotatable against the band material, or by combining with various conventional forming rolls or driving systems in the same forming stand.

BRIEF DESCRIPTION OF THE DRAWINGS

FIG. 5 is a drawing illustrating a pipe mill and the forming rolls showing a conventional continuously roll forming process.

DESCRIPTION OF THE PREFERRED EMBODIMENTS

Figure 7:
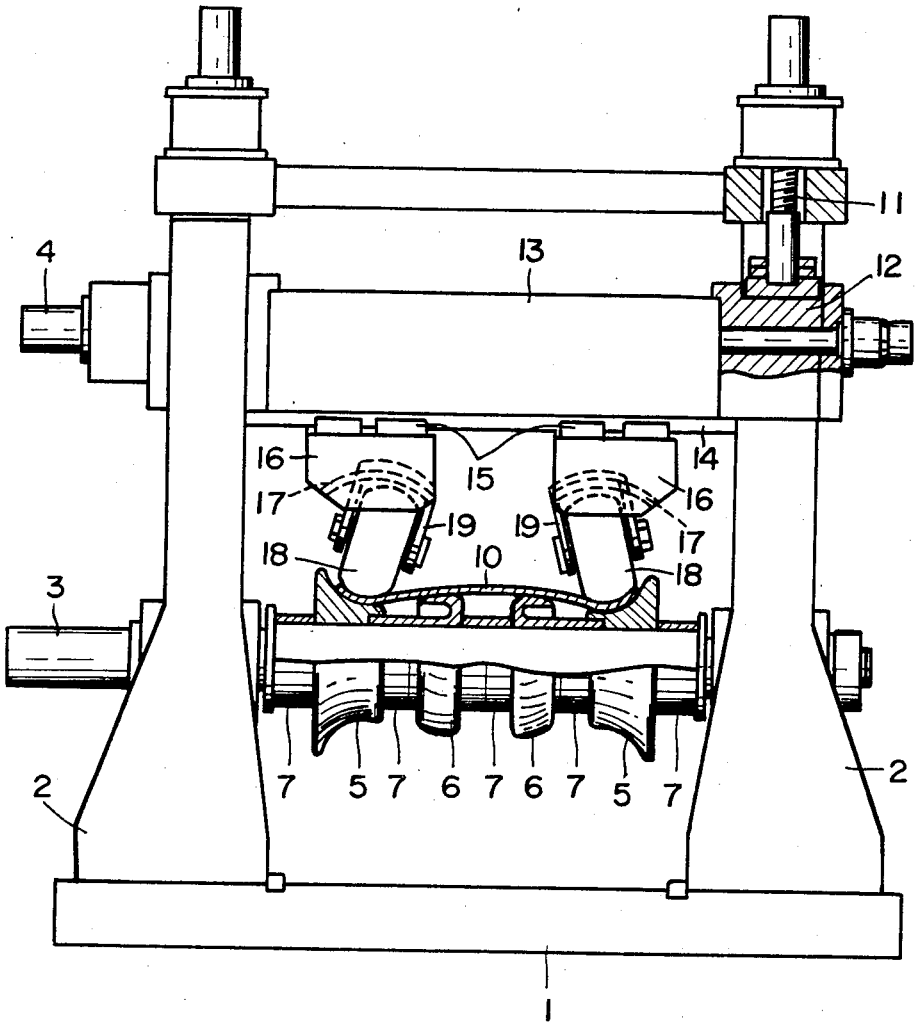
FIG. 7 is a front view of an edge forming apparatus of a band steel using a forming roll in accordance with the present invention.
Figure 8:
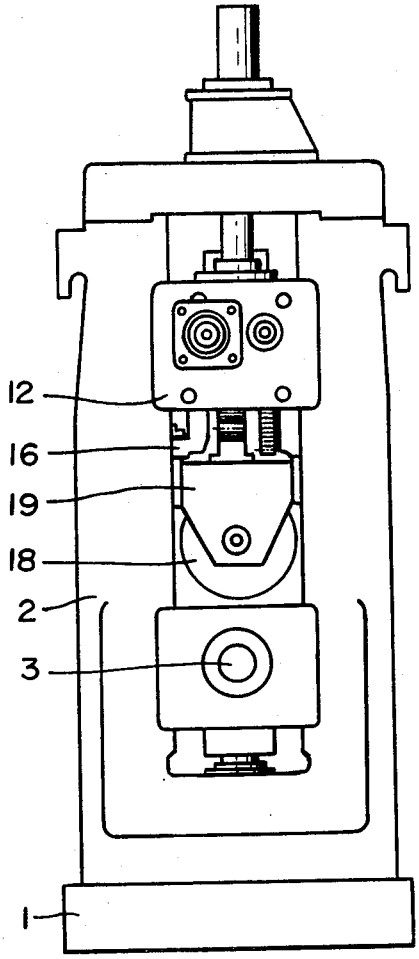
FIG. 8 is a side view of the edge forming apparatus of the band steel.
Figure 9:
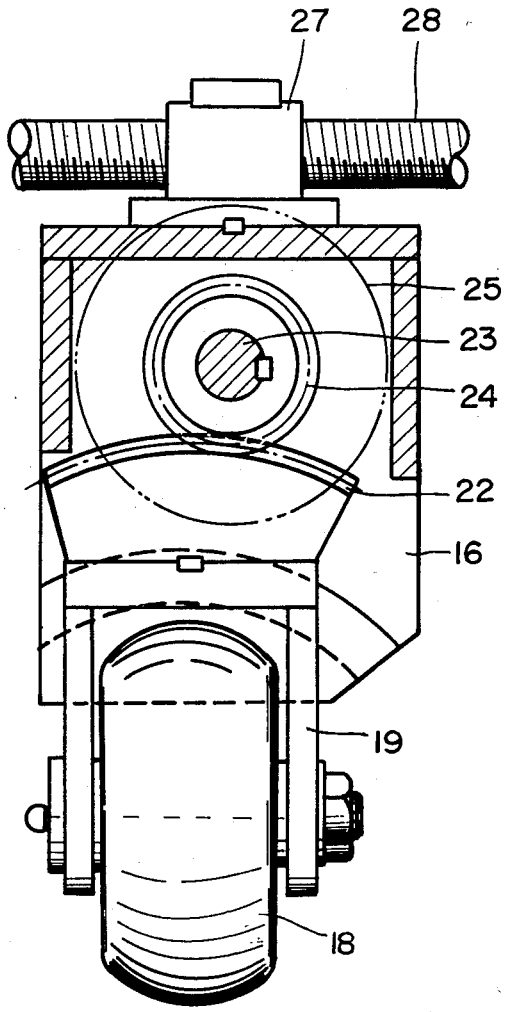
FIGS. 9 and 10 are drawings particularly illustrating front and sectional side views of the upper roll of the edge forming apparatus of the band steel.
Figure 10:
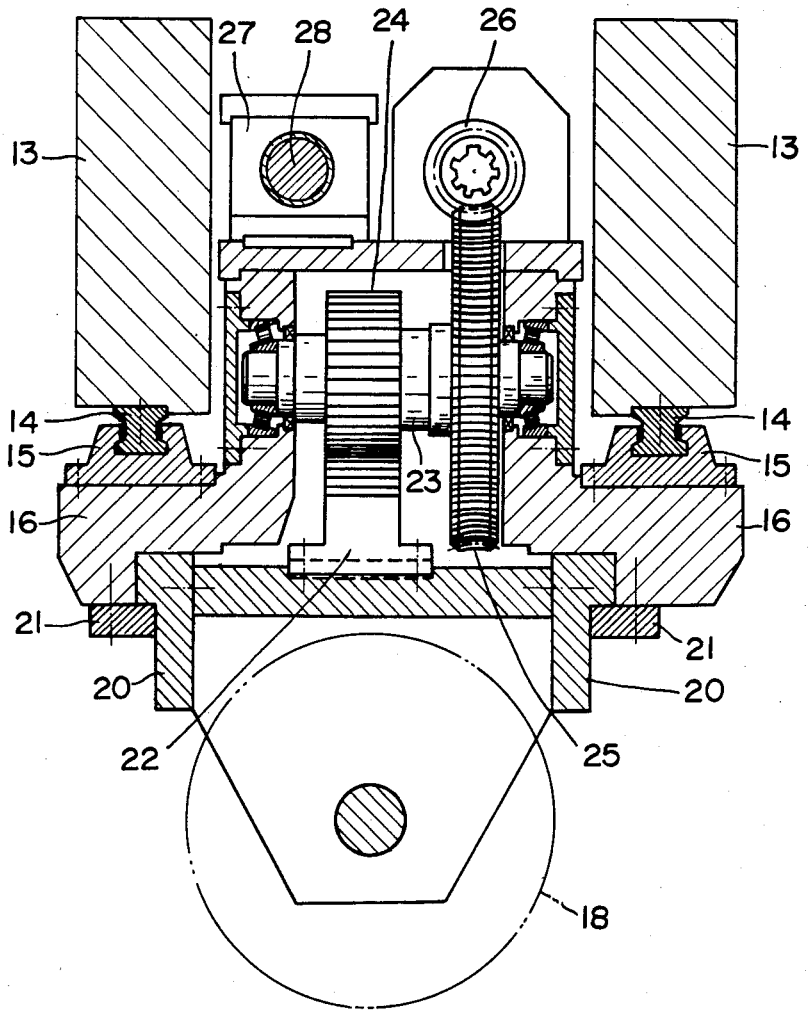
Figure 11:
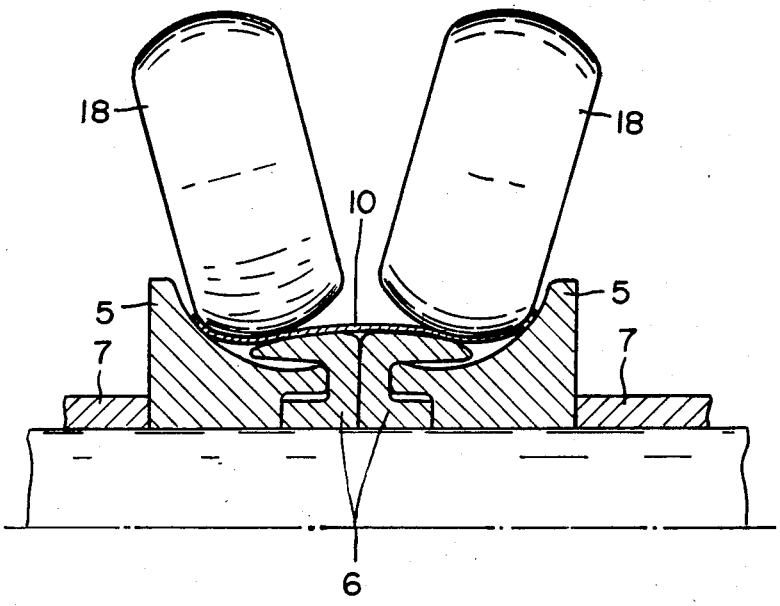
FIG. 11 is a drawing illustrating the forming rolls showing the upper roll in the most adjacent state in the lateral direction of the band steel in the edge forming apparatus of the band steel.
Figure 12:
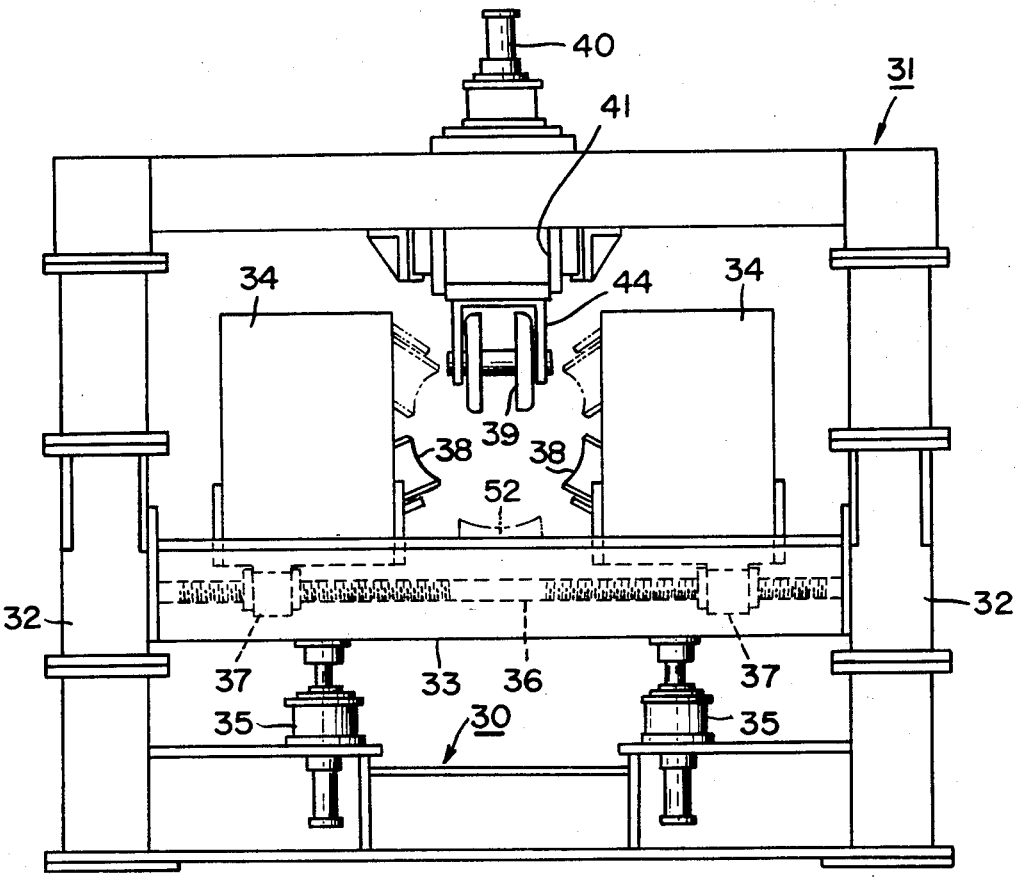
FIG. 12 is a front view of a forming apparatus of the center portion of the band steel using the forming roll in accordance with the present invention.
Figure 13:
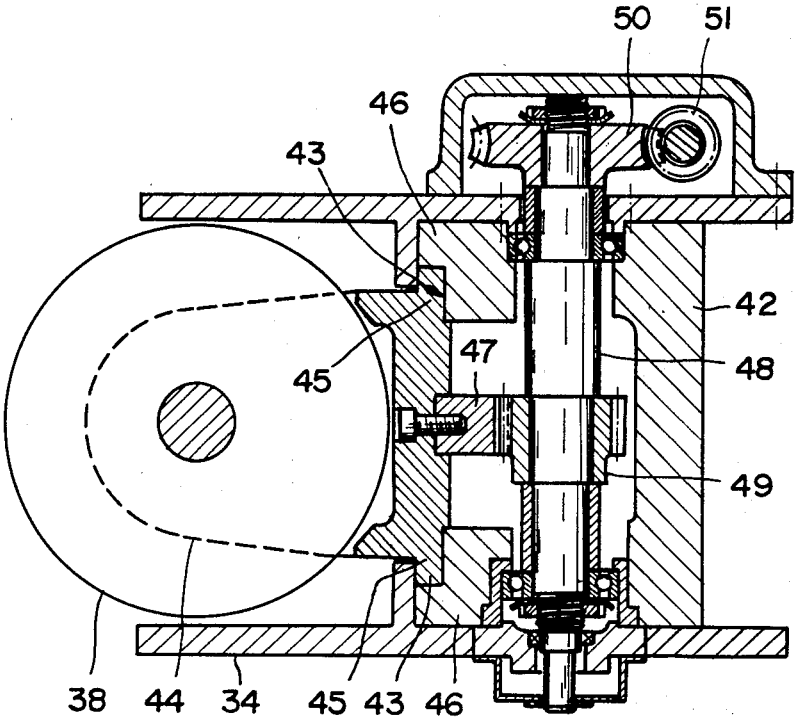
FIGS. 13 and 14 are front and vertical sectional views showing details of the side rolls of the center forming apparatus of the band steel.
Figure 14:
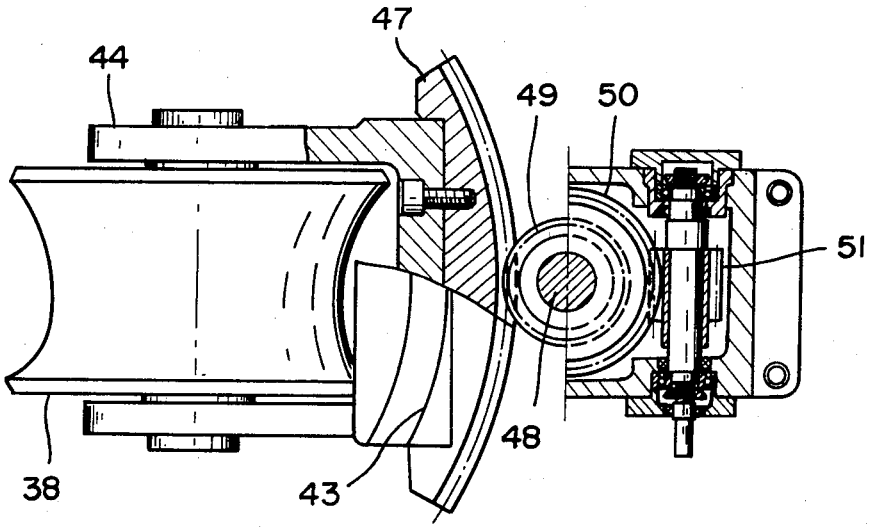

In the present invention, for example, as are shown in FIG. 7 or 11, in order to bend the large diameter or small diameter pipes with a single set of forming rolls, a part or the whole sectional curve of the roll surface of the upper and lower forming rolls (5) (18) of the forming roll for bending the edge of the band steel is, in the drawing, made to agree with the lower curved surface of the lower forming roll (5) in the edge bending of the wider band material (10), and with the upper curved surface of the lower forming roll (5) in the edge bending of the narrower band material (10), so as to agree with the curve of the edge portion of the band material (10) in each roll flower diagram of pipes having various outside diameters previously set, and said forming roll is moved responsive to the required diameter or the width of the band material to locate the required curved surface at the fixed position, so that not only a pair of upper and lower rolls bending the edge portion are moved in the lateral direction of the band material, at least the roll surface of the upper roll should be turned.

Figure 4:
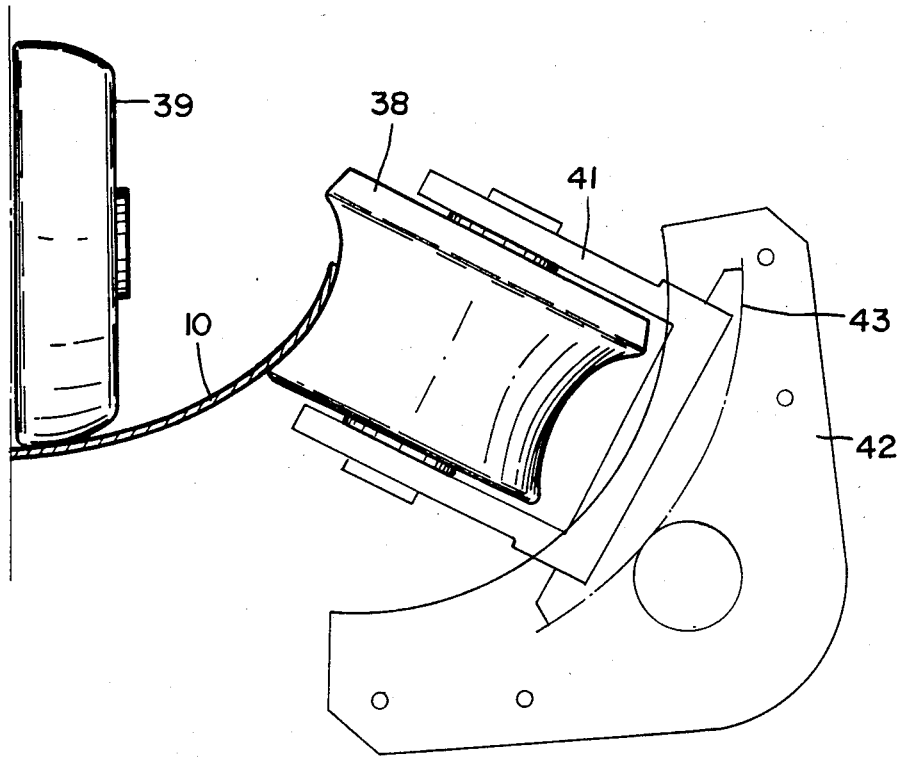
FIGS. 4, 5 and 6 are drawings illustrating the side and intermediate rolls in accordance with the present invention.
Figure 5:
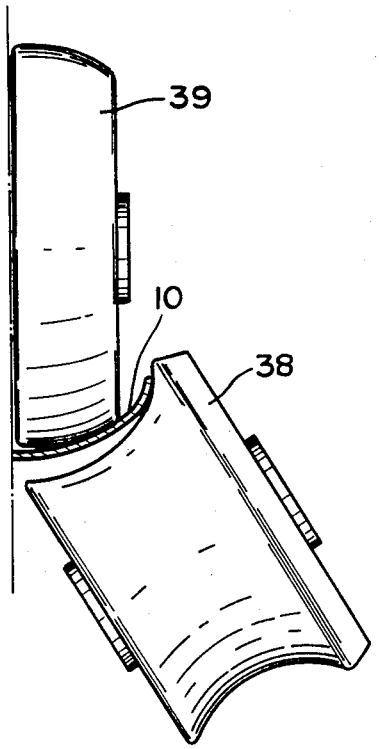
Figure 6:
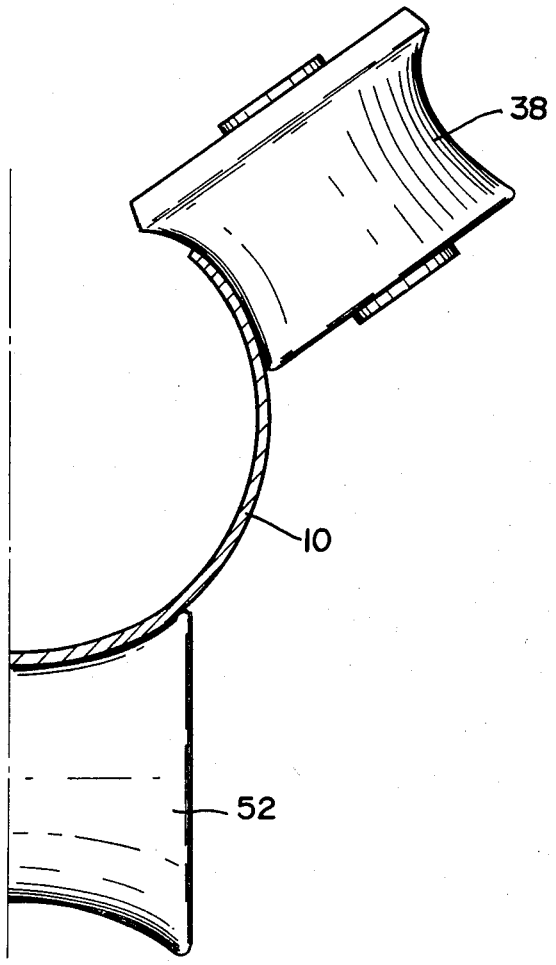

Meanwhile, in the forming roll for the center portion of the band material, as are shown in FIGS. 4 through 6, in order to bend the edge portion of the band material for the pipes having large and small diameters with a single forming roll, a part or the whole sectional curve of the roll surface of the forming roll (38) arranged on the side is, as is shown in FIG. 4, made to agree with the lower curved surface of the forming roll (38) in forming the center portion of the wider band material (10), and with the upper curved surface of the forming roll (38) in forming the center portion of the narrower band material (100) as is shown in FIG. 5, so as to agree with the curve of the edge of the band material in each roll flower diagram of the steel pipes having various outside diameters previously set, and responsive to the required diameter or the required width of the band material, said forming roll is moved to locate the required curved surface at the fixed position.

It is also possible to use as an upper intermediate roll contacting the center portion of the band material from above, and from the same principle, it is desirable to divide into two sections so as to be movable to and from each other in the lateral direction of the band material, in such a manner that a part or the whole sectional curve of the roll surface of the intermediate roll (39), will agree with the curve of the center portion of the band material (10) in each roll flower diagram of the steel pipes having various outside diameters previously set, and responsive to the required diameter or the band width, to move it laterally and vertically to locate the curved surface at the fixed position.

As described above, the forming roll in accordance with the present invention, for the purpose of enlarging the commonly used range, includes the roll surface having a sectional shape of an approximate involute curve, the required curve surface of the roll is suitably selected responsive to the diameter, that is, an idea of moving the forming roll itself to agree with the edge portion of the band material may be utilized.

More specifically, in the production of steel pipes having various kinds of diameters, and in certain fixed forming stage, the approximate involute curve previously described is applied to provide, for example, a continuously smooth curved surface including all various kinds of circular arcs necessary for forming all kinds of edge portions of the band material, to the roll surface.

Figure 1:
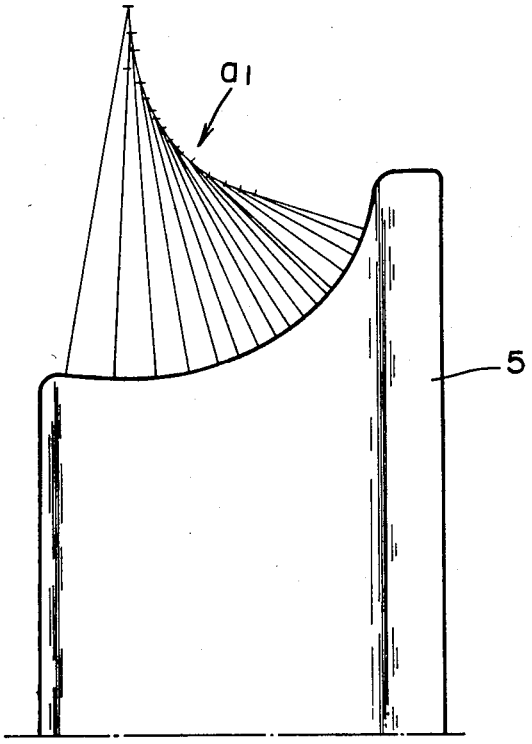
FIGS. 1, 2 and 3 are drawings illustrating forming rolls used in a forming process in accordance with the present invention, in which lower, side and upper rolls are shown respectively.
Figure 2:
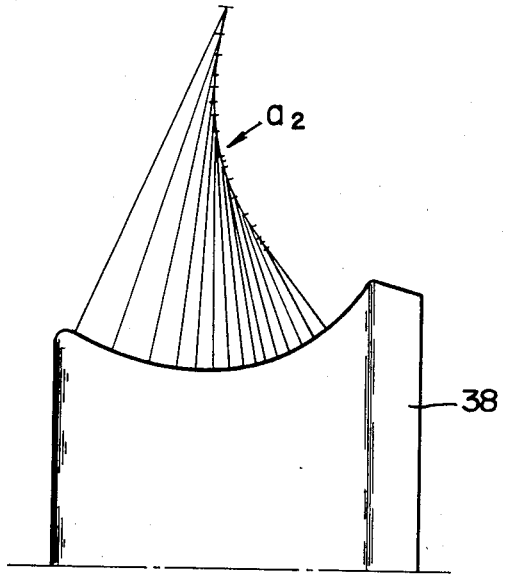
Figure 3:
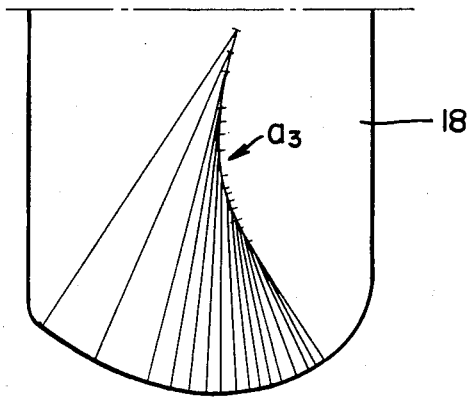

That is, the conventional forming roll having the curved surface such as the double radius is hardly applicable as the common roll, but if the involute curve based upon the circle having certain radius is given to the roll surface, it may be changed into a forming roll having a broader commonly used range, moreover as is shown in the embodiment, in order to obtain the forming roll having a considerably wide commonly used range possible of forming several tens of kinds of diameters by a single roll, it is necessary to have a continuous circular arc surface including various kinds of circular arcs having the abovementioned necessary radius and length differing respectively, so that the involute curve based upon the polygon having a number of sides assumed as the circular arc illustrated in FIGS. 1 through 3 may be used.

The roll surface of the forming roll will be explained more specifically with reference to the upper and lower rolls in FIGS. 1, 2 and 3. The roll surface of such forming roll comprises the the sectional shape of involute curve obtained from a side or sides of polygon (portion a1, a2 and a3 in the drawing) having a plurality of sides previously set, responsive to the kinds of required diameters, thicknesses and edge bending stages, through which the roll surface is brought in agreement with the curve of the edge portion or the center portion of the band material of the roll flower of the steel pipes, having various diameters and thicknesses in the roll forming from small diameter to large diameter pipes, and to contact and press the edge or center portion of the band material.

Meanwhile, it has been discovered that the spring back of the edge portion of the band material may be prevented by the forming roll in accordance with the present invention, by rendering the sectional shape of an approximate involute curve to its roll surface. Referring to its mechanism in detail, in general, even the forming is performed by the roll having the curved surface of fixed curvature, although depending upon the characteristic, thickness and curvature of the material, the plate bent along the roll surface in the pressing, is formed in the curvature changed continuously by the spring back after passing through the forming roll.

That is, in the forming roll having the curve surface of fixed curvature, as the bending moment arm is changed and approaches 0 in the proximity of the edge portion of the band material, the stress applied to the material is changed depending upon the lateral portion of the band steel, and the forming fixed curvature may be substantially impossible.

However, if the radius of curved surface is reduced as approaching closer to the edge portion of the band material, the bending of required fixed radius may be performed regardless of the spring back. In the roll surface of the forming roll in accordance with the present invention, as are shown in FIGS. 1, 2 and 3, since the curved surface of sectional shape of the roll surface has the curvature changing continuous as if converging into a certain assumed curvature, the radius of the curved surface may be reduced as approaching closer to the edge portion of the band material, which may be effectively formed into the curved surface having the fixed radius.

Accordingly, in the edge bending process of the band material, the edge bending is performed sufficiently, and even when the following forming process of the center portion is performed without the edge portion being bent sufficiently in the preceding process, the side roll in accordance with the present invention having the abovementioned constructions and advantages, is able to compensate such insufficient edge bending besides forming the center portion simultaneously, thus the circle having the require diameter and shape may be formed.

As are shown in FIGS. 1, 2 and 3, since the sectional shape of the roll surface is of the approximate involute curve, and the curved surface may be reduced as approaching closer to the edge portion of the band material, the side roll is able to contact the edge bending portion in line as holding thereof, thus the rolling of the material being formed is prevented, and when used as a cage roll, the number of rolls may be considerably reduced.

That is, in the continuous roll forming process utilizing the forming roll in accordance with the present invention, only the forming roll having the abovementioned shape is used, or the conventional roll are commonly used in various combinations to reduce the stages and/or the number of forming rolls, furthermore, the forming and production of pipes suitable for producing the pipes having various diameters and thicknesses, in a broader range from the small to large diameter pipes may be performed by a single set of forming rolls without changing it, besides the insufficient edge bending is compensated and the influence of its spring back may be reduced, thus the formability in the initial and intermediate forming stages in the pipe mill can be considerably raised, and since the insufficient edge bending is decreased, the amount of forming in the succeeding reducing region is reduced, and the continuous roll forming may be performed with a good forming distribution and a high formability.

In the forming roll in accordance with the present invention, preferably the distance of upper, lower and side rolls contacting the opposite ends of the band material may be changed responsive to the band width, and corresponding to the width of the band material being formed and the required forming stages, the construction may be in such that the edge portion is capable of contacting with a part or the whole surface of said involute curve of the sectional shape of the roll previously set, and that the roll surface is swingable in a circular arc in the lateral direction of the band material.

Although the typical samples of edge bending and side rolls of the band material have been heretofore described, the forming roll in accordance with the present invention may be applicable to any forming rolls in the pipe mill irrespective of driven or not driven, or applicable to the pipe forming rolls of various metals and alloys including the abovementioned band material.

Furthermore, a specific involute curve of the roll surface specializing the forming roll in accordance with the present invention, may be suitably selected responsive to the kinds and number of stages of rolls such as the upper, lower, side, lower horizontal, upper and lower intermediate rolls applicable in various forming processes, and other conditions such as the required diameter, thickness and the forming distribution in the forming line.

EMBODIMENTS

Embodiment 1

A forming apparatus of the edge portion of the band material comprises an usual roll stand, arranged with a lower roll shaft (3) and an upper roll shaft (4) between U-shaped roll stands (2)(2) disposed on a pedestal (1) in a fixed distance.

On the lower roll shaft (3), a pair of lower rolls (5)(5) and intermediate rolls (6)(6) divided into two sections and interposed therebetween, are positioned and fixed axially at the fixed positions via spacers (7) having various widths. Here the lower roll shaft (3) serves as a driving shaft and driven by a motor, not shown.

The upper roll shaft (4) holding a pair of non-driven upper rolls (18)(18) in suspension, is connected to screw shafts (11) screwed onto the upper end of the roll stands (2)(2) at supporting shaft bodies (12), and constructed between the roll stands (2)(2) movably vertically so as the distance to the lower roll shaft (3) may be adjusted to deal with the thickness of the band steel (10), and to increase or decrease a pressing quantity.

The upper roll shaft (4) is constructed by arranging a pair of beam members (13) between the supporting shaft bodies (12) disposed between the roll stands (2), and rails (14) are laid on the undersurface of each beam member (13).

On the rails (14), saddle-backed upper roll holders (16) are held in suspension via sliding brackets (15) which are slidable and engageable with the rails (14), as projecting its head between a pair of beam members (13).

The inner surfaces of the upper roll holders (16) facing downward form cylindrical seat surfaces (17) in the direction of said rails (14). On the upper portions of U-shaped bearing members (19) supporting the upper rolls 18, fan-shaped contacting members (20) contacting said cylindrical seat surfaces (17) are disposed and held slidably between the cylindrical seat surfaces (17) by fan-shaped receiving members (21) secured to the upper roll holders (16).

On the upper surfaces of the abovementioned bearing members (19), there are provided fan-shaped tooth surfaces (22) which engage gears (24) arranged on small shafts (23) disposed within the head portions of the saddle-backed upper roll holders (16) in the feeding direction of the band steel (10), then worm wheel (25) provided on the small shafts (23) mate with a worm gear (26) arranged between the supporting shaft bodies (12), by the rotation of which the bearing members (19) of the upper roll (18) are moved in a circular arc, and the contacting direction of the roll surface of the upper roll (18) may be changed laterally against the band steel (10).

In the drawing, the tooth surfaces of respective worm wheel (25) are formed inversely so as to swing a pair of right and left upper rolls (18) circularly inversely from each other.

On the head portion of the saddle-backed upper roll holders (16), nut members (27) are secured to engage a screw shaft (28) arranged between the supporting shaft bodies (12), and the upper roll holders (16) are moved in the lateral direction of the band steel (10) as the screw shaft (28) is rotated, thus the upper rolls (18) are moved in the same direction. In the drawing, for the purpose of moving a pair of right and left upper rolls (18) to and from each other, the direction of screws of the nut members (27) secured on the head portion of the respective saddle-backed upper roll holders (16) are threaded inversely.

While the lower rolls (5)(5) and intermediate rolls (6)(6) are, as previously described, positioned on the lower roll shaft (3) via the spacers (7) to adjust the position against the band steel (10), the upper rolls (18)(18) are also formed to change the lateral direction and the contacting direction of the roll surface against the band steel (10).

Moreover, the upper rolls (18)(18), lower rolls (5)(5) and intermediate rolls (6)(6) comprise the forming roll having the sectional shape of approximate involute curve, so as the respective roll surfaces will agree with the curve of the edge portion of band material in each roll flower of the pipes having various diameters, assuming the forming of various steel pipes having the required outside diameter, for example, from 89.1 mmϕ to 193 mmϕ.

In the forming apparatus in accordance with the present invention constructed as above, for example, when bending the edge portion of the band steel in the forming of steel pipes having relatively larger diameters, as is shown in FIG. 7, the distance of rolls may be changed responsive to the band width, so as a pair of forming rolls or a pair of sets of upper and lower rolls (18) and (5), are positioned at opposite ends of the band steel (10) having the required width, and further the pressing direction of the upper roll (18) and the contacting direction against the band steel (10) are changed, and responsive to the width of the band material (10) being formed and the required bending stages, or the number of stages required to complete the bending, the edge portion of the band material (10) is formed into the required shape by the required curved surface portion of the approximate involute curve of the sectional shape of the forming roll previously set, here by the center curved surface portion.

In this case, in order to improve the formability of both edge portions by protruding the center portion of the band steel, the intermediate rolls (6) are used, but the distance between a pair of intermediate rolls (6)(6) is also selected suitably responsive to the band width and the required stages.

In case of the minimum assumed diameter, as is shown in FIG. 11, the lower rolls (5)(5) and the intermediate rolls (6)(6) are integrally arranged without interposing the spacer therebetween, and the contacting direction of the upper rolls (18)(18) are also changed inversely from the previous case to form the edge portion of the band steel (10) into the required shape, by the required curved portion of the approximate involute curve of the forming roll sectional shape previously set, here by the outermost curved portion.

As previously described in detail, the forming apparatus in accordance with the present invention, is capable of bending the edge of the band steel suitable for the production of steel pipes having various diameters in a broader range from a small diameter to a large diameter pipes.

Meanwhile, by rendering the sectional shape of approximate involute curve to the roll surface of the lower roll, it is possible to agree with the curve of the edge portion in each roll flower of the pipes having various diameters, besides the outermost edge portion may be set in the shape possible to be bent slightly over, and the center portion of the band steel is protruded inversely to facilitate the forming of the edge portion, so that the influence of spring back of the edge portion is reduced, and the formability in the initial forming in the pipe mill is considerably raised to reduce the improper edge portion, thus the amount of forming in the following forming region of the center portion and the reducing region may be reduced, providing the continuous roll forming having a high formability and a good forming distribution.

Embodiment 2

A forming apparatus of the center portion of the band steel in accordance with the present invention will be explained in detail.

The forming apparatus comprises a pedestal (30) on which a gate stand (31) is erected, pillar frames (32) disposed on the center portions of both stands and serving as sliding support frame, to which a sliding frame body (33) provided with a pair of side roll holders (34) are engaged at the both ends between said pillar frames (32)(32), and a pair of hydraulic cylinder (35) secured to the pedestal and carrying the sliding frame body (33) movably vertically.

Non-driven side rolls (38) are pivoted movably in a required circular arc, the side roll holders (34) formed with box bodies are placed slidably on the above mentioned sliding frame body (33), on the bottom of the holders (34), nut members (37) are secured and engaging a screw shaft (36) arranged within the sliding frame body (33). As the screw shaft (36) is rotated by motors (not shown) incorporated in both sides of the sliding frame body (33) engaging the pillar frames (32), the side roll holders (34) are moved axially or in the lateral direction of the band steel to move the side rolls (38) in the same direction. In the drawing, in order to move a pair of right and left holders (34) to and from each other, the screw shaft (36) mating with the nut members (37) secured on the bottom of the respective holders (34) are threaded inversely.

An upper intermediate roll (39) consisting non-driven rolls divided into two sections, a distance between a pair of rolls being adjustable through a spacer not shown, is connected to a screw shaft (40) screwed onto the upper end of the gate stand (31) at its shaft supporting member (41), and formed between the roll stand (31) movably vertically, so as its facing distance against the sliding frame body (33) movable vertically, is adjustable to deal with the thickness of the band steel, and to increase and decrease the contacting quantity.

The inner surfaces of roll holding seats (42) directing laterally and fixed within the side roll holders (34) form vertical cylindrical seat surfaces (43). On the upper portions of U-shaped bearing members (44) supporting the side rolls (38), fan-shaped contacting members (45) contacting abovedescribed cylindrical seat surfaces (43) are disposed, and held slidably therebetween by fan-shaped receiving members (46) secured on the roll supporting seats (42).

On the upper surface of the aforesaid bearing member (44), a fan-shaped tooth surface (47) is provided to engage a gear (49) arranged on a small shaft (48) disposed in the roll supporting seats (42) in the moving direction of the band material. A worm wheel (50) disposed on to the shaft portion of the small shaft (48), projecting outwardly from the side roll holder (34) is further engaging a worm gear (51), by the rotation of which the bearing member (44) of the side roll (38) is moved circularly, and the contacting direction of the roll surface of the side roll (38) may be changed laterally against the band steel with the bent edge.

Furthermore, assuming the forming of various steel pipes having required diameters, for example, from 89.1 mmϕ to 193 mmϕ, and in order to bring respective roll surfaces in agreement with the curves of the edge bending or center portion of the band steel in back roll flower of the pipes having various diameters, a pair of side rolls (38), upper intermediate rolls (39) comprises the forming rolls having the sectional shape of approximate involute curve.

In the forming apparatus in accordance with the present invention constructed as above, for example, when bending the edge portion of the band steel in the forming of steel pipes having relatively larger diameters, as is shown in FIG. 4, the distance of rolls may be changed responsive to the band width, so as a pair of side rolls (38) are positioned at opposite ends of the band steel having the required width, and a set of upper intermediate rolls (39) at the center portion, and further the pressing direction of the side rolls (38) and the contacting direction against the band steel are changed, and responsive to the width of the band steel being formed and the required bending stages, or the number of stages requirement to complete the bending, the band steel is formed into a required circular shape by the required curved portion of the approximate involute curve of the sectional shape of the roll surface previously set, as contacting and carrying the edge bending portion of the band steel.

In this case, the distance and vertical position of a pair of upper intermediate rolls (39) contacting the center portion of the band steel, may be selected suitable responsive to the band width and the forming stages.

In case of the minimum assumed diameter, as shown in FIG. 5, the upper intermediate rolls (39) are arranged integrally without interposing the spacer therebetween, and the contacting direction of the side rolls (38) are also changed inversely from the previous case to form the edge portion of the band steel into the required shape, by the required curved surface portion of the approximate involute curve of the forming roll sectional shape previously set, here by the outermost curved portion.

The cases described heretofore are, as are shown in FIGS. 4 and 5, relatively in the initial and intermediate stages in the forming process of the center portion of the band steel, in which the roll surface of the side roll (38) changes from the upper to lateral direction, or from the stage same as the edge bending to the stage forming one-half or two-thirds circle.

When forming substantially into a round shape from this stage, as is shown in FIG. 6, in place of the above-mentioned upper intermediate roll (39), a lower horizontal roll (52) contacting the center portion of the band steel from below is arranged movably vertically, and the pressing direction of side roll (38) is changed from the previous lateral direction to the downward direction to perform the multi-stage forming, or from the standpoint of the material being formed, since its edge portion is formed into a required circular shape as being continuously carried by the side roll (38) agreeing with its bending shape, it will be appreciated that the side roll (38) having a high formability may be used commonly in a broader range.

As particularly described, in the forming apparatus in accordance with the present invention, the forming of the band material suitable for the production of steel pipes having various diameters in a broader range from the small to large diameters may be performed.

Since the side roll surface, as is shown in FIG. 2, has the sectional shape of approximate involute curve, the radius of its curved surface may be made smaller as approaching closer to the edge portion of the band material, which may be contacted in the line contact as being carried by the side roll to prevent the rolling, and further the edge bending can be corrected to reduce the influence of the spring back, thus the formability in the initial and intermediate stages of forming is raised and the improper edge portion can be reduced, so that the amount of forming in the following reducing region is decreased, and the continuous roll forming with a high formability and a good forming distribution may be performed.

What is claimed is:

1. A forming roll for the pipe mill characterized in that, in forming each portion of the band material in the forming region in the production of pipes by a continuous roll forming, a part or the whole sectional curve of a roll surface includes the sectional curve comprising an involute curve based upon a polygon having a plurality of sides previously set, so as to agree with the curve of the required portion of the band material of each roll flower of the steel pipes having various diameters in said forming region.

2. Forming roll apparatus for a pipe mill characterized in that, in forming each portion of the band material in the forming region in the production of pipes by continuous roll forming, in order to form with a part or the whole roll surface by changing the contacting direction of a forming roll responsive to the width of the material being formed and the required forming stage, a part or the whole sectional curve of the roll surface includes a sectional curve comprising an involute curve based upon a polygon having a plurality of sides previously set, so as to agree with the curve of the required portion of the band material of each roll flower of the steel pipes having various diameters in said forming region.

3. Forming roll apparatus for a pipe mill characterized in that, in forming each portion of the band material in the forming region in the production of pipes by continuous roll forming, in order to form with a part or the whole roll surface by changing the contacting direction of a forming roll responsive to the width of the material being formed and the required forming stage, a part or the whole sectional curve of the roll surface includes a sectional curve comprising an involute curve based upon a polygon having a plurality of sides previously set, so as to agree with the curve of the required portion of the band material of each roll flower of the steel pipes having various diameters in said forming region, wherein said roll apparatus includes a pair of upper and lower forming rolls for bending the edge portion of the band material, and wherein the contacting direction of at least one of said rolls is changeable.

4. Forming roll apparatus for a pipe mill characterized in that, in forming each portion of the band material in the forming region in the production of pipes by continuous roll forming, in order to form with a part or the whole roll surface by changing the contacting direction of a forming roll responsive to the width of the material being formed and the required forming stage, a part or the whole sectional curve of the roll surface includes a sectional curve comprising an involute curve based upon a polygon having a plurality of sides previously set, so as to agree with the curve of the required portion of the band material of each roll flower of the steel pipes having various diameters in said forming region, wherein said roll apparatus includes an upper or lower forming roll for bending the edge portion of the band material divided in a lateral direction of the band material.

5. Forming roll apparatus for a pipe mill characterized in that in forming each portion of the band material in the forming region in the production of pipes by continuous roll forming, in order to form with a part or the whole roll surface by changing the contacting direction of a forming roll responsive to the width of the material being formed and the required forming stage, a part or the whole sectional curve of the roll surface includes a sectional curve comprising an involute curve based upon a polygon having a plurality of sides previously set, so as to agree with the curve of the required portion of the band material of each roll flower of the steel pipes having various diameters in said forming region, wherein said roll apparatus includes a side roll.

6. Forming roll apparatus for a pipe mill characterized in that in forming each portion of the band material in the forming region in the production of pipes by continuous roll forming, in order to form with a part or the whole roll surface by changing the contacting direction of a forming roll responsive to the width of the material being formed and the required forming stage, a part or the whole sectional curve of the roll surface includes a sectional curve comprising an involute curve based upon a polygon having a plurality of sides previously set, so as to agree with the curve of the required portion of the band material of each roll flower of the steel pipes having various diameters in said forming region, wherein said roll apparatus includes an upper or lower intermediate roll divided in a lateral direction of the band material.

7. Forming roll apparatus for a pipe mill characterized in that in forming each portion of the band material in the forming region in the production of pipes by continuous roll forming, in order to form with a part or the whole roll surface by changing the contacting direction of a forming roll responsive to the width of the material being formed and the required forming stage, a part or the whole sectional curve of the roll surface includes a sectional curve comprising an involute curve based upon a polygon having a plurality of sides previously set, so as to agree with the curve of the required portion of the band material of each roll flower of the steel pipes having various diameters in said forming region, wherein said roll apparatus includes a cage roll.

8. A forming process of the band material in the pipe mill, said process comprising: in the forming of any or all forming regions in the production of pipes by a continuous roll forming, providing a forming roll having the sectional shape of an involute curve based upon a polygon comprising a plurality of sides previously set, so that a part or whole sectional curve of the roll surface of the forming roll agrees with the curve of the required portion of the band material in each roll flower of the pipes having various outside diameters in said forming region, and formed by a part or whole surface of the roll surface, and changing the contacting direction of said forming roll responsive to the width of the material being formed and the required forming stages.

9. A forming process of the edge portion of the band material in the pipe mill, said process comprising: in the forming of the forming region of the edge portion of band material in the production of steel pipes by a continuous roll forming, providing a forming roll having the sectional shape of an involute curve based upon a polygon comprising a plurality of sides previously set, so that a part or whole of the sectional curve of the roll surface of the forming roll agrees with the curve of the edge portion of the band material in each roll flower of the pipes having various diameters; forming both edge portions of the band material by a set of upper and lower forming rolls having the sectional shape of said involute curve; when performing such forming in a single stage or in multi-stages, changing the distance of pairs of forming rolls at both edge portions of the band material responsive to the band width; changing the reducing direction of at least the upper forming roll of each set of forming rolls; responsive to the width of the material being formed and the required edge bending stages, using a part or the whole surface of said involute curve of the sectional shape of the forming roll previously set.

10. A forming process of the edge portion of the band material in the pipe mill, said process comprising: in the forming of the forming region of the edge portion of band material in the production of steel pipes by a continuous roll forming, providing a forming roll having the sectional shape of an involute curve based upon a polygon comprising a plurality of sides previously set, so that a part or whole of the sectional shape of the roll surface of the forming roll agrees with the curve of the edge portion of the band material in each roll flower of the pipes having various diameters; forming both edge portions of the band material by a set of upper and lower forming rolls having the sectional shape of said involute curve; when performing such forming in a single stage or in multi-stages, changing the distance of pairs of forming rolls at both edge portions of the band material responsive to the band width; providing a roll projecting the center portion of the band material upwardly; changing the reducing direction of at least the upper forming roll of each set of forming rolls; and responsive to the width of the material being formed and the required bending stage, using a part or the whole surface of said involute curve of the sectional shape of the forming roll previously set; and forming the center portion of the band material into a circular shape in the following stage.

11. A forming apparatus of the edge portion of the band material in the pipe mill, characterized in that in the forming of forming region of the edge portion of the band material in the production of pipes by a continuous roll forming, the forming roll forming both edge portions of the band material, comprises a set of upper and lower rolls consisting of an upper male roll and a lower female roll disposed in vertically spaced relationship movably, and the sectional shape of involute curve based upon a polygon comprising a plurality of side previously set, so as a part or whole of the sectional curve of its roll surface agrees with the curve of the edge portion of the band material in each roll flower of the pipes having various diameters, the abovementioned set of upper and lower rolls, a pair of forming rolls are separately arrange movably in the lateral direction of band material, further the distance of pair of forming rolls at both edge portions is changed responsive to the band width, the upper roll is supported in such that its roll surface is swingable circularly in the lateral direction of the band material, so as a part or whole surface of said involute curve of the sectional shape of the forming roll previously set is capable of contacting with the edge portion of the band material responsive to the band width and the required edge bending stages, and an intermediate roll divided into two sections so as to be movable to and from each other in the lateral direction of the band material, is disposed between a pair of lower rolls to render a projection, flat or recess to the center portion of the band material.

12. A forming apparatus of the edge portion of the band material in the pipe mill in accordance with claim 11, characterized in that an upper roll is supported by a bearing member provided with a fan-shaped tooth surface in the fan-shaped upper center, said bearing member is received by the seat surface of a supporting member having a cylindrical inner face seat, said supporting member is slidably connected to a slide rail arranged on the forming stand in the lateral direction of the band plate, the circular swing of the roll surface of the upper roll is controlled by the rotation of a gear engaging said fan-shaped tooth surface, and the distance of a pair of upper rolls is controlled by the feeding slide of the supporting member.

13. A forming process of the center portion of the band material in the pipe mill, said process comprising: in forming the forming region of the center portion of the band material after the edge bending in the production of pipes by a continuous roll forming, providing a forming roll having the sectional shape of an involute curve based upon a polygon comprising a plurality of sides previously set, so that a part or whole of the sectional shape of the roll surface agrees with the curve of the edge portion of the band material in each roll flower of the pipes having various outside diameter; pressing the edge bending portion of the band material by the forming roll having the sectional shape of said involute curve; when forming the band material substantially in a circular shape by arranging the forming roll in a single stage or multi-stages, changing the distance of a pair of forming rolls responsive to the band width; and changing the contacting directions of each forming roll respective to the width of the material being formed and the required forming stages to use a part or the whole surface of said involute curve of the sectional shape of the forming roll previously set.

14. A forming process of the center portion of the band material in the pipe mill, said process comprising: in the forming of the forming region of the center portion of the band material in the production of pipes by a continuous roll forming, providing a forming roll having the sectional shape of an involute curve based upon a polygon comprising a plurality of sides previously set, so as a part or whole of the sectional shape of the roll surface agrees with the curve of the edge or center portion in each roll flower of the pipes having various diameters; contacting the center portion of the band material with a pair of upper intermediate rolls and/or a horizontal roll capable of contacting and disengaging in the lateral direction of the band material in the sectional shape of said involute curve; pressing the edge bending portion by contacting the forming roll having the sectional shape of said involute curve; when the band material is formed substantially in a circular shape by arranging said upper intermediate roll and the forming roll in a single stage or multi-stages, changing the distance of a pair of forming roll responsive to the band width; and changing the contacting directions of each forming roll responsive to the width of the material being formed and the required forming stages, to use a part or the whole surface of said involute curve of the sectional shape of the forming roll previously set.

15. A forming apparatus of the center portion of the band material in the pipe mill, characterized in that in the forming of the forming region of the center portion of the band material after the edge bending in the production of pipes by a continuous roll forming, a forming roll having the sectional shape of involute curve based upon a polygon comprising a plurality of sides previously set is used, so as a part or whole of the roll surface of a pair of side rolls contacting and pressing the edge bending portion agrees with the curve of the edge portion of the band material in each roll flower of the pipes having various diameters, and the side roll retaining portion supporting its roll surface swingable circularly in the lateral direction of the band material so as to be contactable with the edge portion of the band material, at a part or whole of the abovementioned involute curve previously set responsive to the band width and the forming stage, is mounted on a slide base separately and movably in the direction of the band material, said slide base being movable vertically, in that a pair of upper intermediate rolls contactable and disengageable in the lateral direction of the band material, and contacting the upper center portion thereof in the sectional shape of involute curve based upon the polygon comprising a plurality of sides previously set, so as a part or whole of the roll surface agrees with the curve of the center portion of the band material in each roll flower of the pipes having various diameters is held movably vertically, and in that a horizontal roll contacting the center portion of the band material from below is arranged movably vertically.

16. A forming apparatus of the center portion of the band material in the pipe mill in accordance with claim 15, characterized in that a side roll is supported by a bearing member provided with a fan-shaped tooth surface in the fan-shaped upper center, said bearing member is received by the seat surface of the supporting member having a cylindrical inner face seat, and the circular swing of the side roll surface is controlled by the rotation of a gear engaging said fan-shaped tooth surface.

17. A forming roll for a pipe mill for forming each portion of a band material in a forming region in the production of pipes by continuous roll forming, said forming roll comprising: a roll having a curved forming surface wherein at least a part of the forming surface is defined in cross section by an involute curve based upon a polygon having a plurality of sides of a predetermined number, the curved surface corresponding in curvature with the curve of a required portion of the band material of each roll flower of the pipes to accommodate various pipe diameters in said forming region.

* * * * *